US009895919B2

(12) United States Patent
Zehetner et al.

(10) Patent No.: US 9,895,919 B2
(45) Date of Patent: Feb. 20, 2018

(54) STAMP AND STAMPING INSERT

(71) Applicant: Trodat GmbH, Wels (AT)

(72) Inventors: Markus Zehetner, Leonding (AT); Konrad Riegler, Eberstalzell (AT); Helmut Lindner, Peuerbach (AT)

(73) Assignee: Trodat GmbH, Wels (AT)

( * ) Notice: Subject to any disclaimer, the term of this patent is extended or adjusted under 35 U.S.C. 154(b) by 0 days.

(21) Appl. No.: 15/177,100

(22) Filed: Jun. 8, 2016

(65) Prior Publication Data

US 2016/0361936 A1 Dec. 15, 2016

(30) Foreign Application Priority Data

Jun. 10, 2015 (AT) ..... A50478/2015

(51) Int. Cl.
*B41K 3/56* (2006.01)
*B41K 1/10* (2006.01)
(Continued)

(52) U.S. Cl.
CPC ..... *B41K 3/56* (2013.01); *B41K 1/04* (2013.01); *B41K 1/10* (2013.01); *B41K 1/12* (2013.01);
(Continued)

(58) Field of Classification Search
CPC ... B41K 1/00; B41K 1/04; B41K 1/38; B41K 1/40; B41K 1/42; B41K 1/56; B41K 1/10; B41K 1/12; B41K 3/56
See application file for complete search history.

(56) References Cited

U.S. PATENT DOCUMENTS 454,499 A 6/1891 Ryer
973,556 A 10/1910 Peterson
(Continued)

FOREIGN PATENT DOCUMENTS

AT 501318 11/2006
AT A50017/2014 1/2014
(Continued)

OTHER PUBLICATIONS

Co-Pending Design U.S. Appl. No. 29/548,144 entitled, "Hand Stamp" to Riegler et al., filed Dec. 10, 2015.
(Continued)

*Primary Examiner* — Leslie J Evanisko
*Assistant Examiner* — Marissa Ferguson Samreth
(74) *Attorney, Agent, or Firm* — Meyertons, Hood, Kilvin, Kowert & Goetzel, P.C.

(57) ABSTRACT

In some embodiments, a stamp comprising at least one stamping component and one stamping insert with a mounted band unit. The stamping component may comprise a top part and a bottom part with a cushion-receiving element. The mounted band unit may be connected so as to move synchronously via a reversing mechanism in the bottom part to the top part. In the resting position a text plate mounted on the stamping insert and a stamping area of the mounted band unit may abut against an ink pad soaked with ink in the cushion-receiving element. During a stamping process for producing a stamp impression the stamping insert can be shifted via the reversing mechanism into a stamping position. On the stamping insert, a height adjustment element for the mounted band unit and/or a text plate carrier may be provided.

18 Claims, 8 Drawing Sheets

(51) Int. Cl.

| | |
|---|---|
| ***B41K 1/12*** | (2006.01) |
| ***B41K 1/38*** | (2006.01) |
| ***B41K 1/04*** | (2006.01) |
| ***B41K 1/40*** | (2006.01) |
| ***B41K 1/42*** | (2006.01) |

(52) U.S. Cl.

CPC ..... *B41K 1/38* (2013.01); *B41K 1/40* (2013.01); *B41K 1/42* (2013.01)

(56) References Cited

U.S. PATENT DOCUMENTS

| | | | | |
|---|---|---|---|---|
| D331,418 | S | 12/1992 | Winston | |
| D359,504 | S | 6/1995 | Stefanski | |
| D367,879 | S | 3/1996 | Smith | |
| D387,800 | S | 12/1997 | Daw | |
| D389,175 | S | 1/1998 | Imamaki | |
| 5,727,467 | A | 3/1998 | Skopek | |
| 5,768,992 | A * | 6/1998 | Daw | B41K 1/38 101/104 |
| D400,566 | S | 11/1998 | Schreiberhuber | |
| 5,850,787 | A * | 12/1998 | Pichler | B41K 1/40 101/105 |
| D417,464 | S | 12/1999 | Skopek | |
| 6,067,905 | A | 5/2000 | Faber | |
| D451,944 | S | 12/2001 | Lipkin | |
| 6,732,649 | B1 | 5/2004 | Wall et al. | |
| 6,813,999 | B2 | 11/2004 | Treml | |
| 6,834,584 | B1 | 12/2004 | MacNeil | |
| 6,892,638 | B2 * | 5/2005 | Sculler | B41K 1/42 101/327 |
| 7,069,852 | B2 | 7/2006 | Zindl | |
| D538,328 | S | 3/2007 | Faber | |
| D540,848 | S | 4/2007 | Faber | |
| D542,335 | S | 5/2007 | Faber | |
| D542,835 | S | 5/2007 | Faber | |
| 7,389,727 | B2 | 6/2008 | Faber | |
| D588,187 | S | 3/2009 | Shih | |
| 7,520,221 | B2 | 4/2009 | Ameshofer | |
| D618,274 | S | 6/2010 | Faber | |
| 7,743,703 | B2 | 6/2010 | Ameshofer | |
| 7,853,353 | B1 | 12/2010 | Hagen et al. | |
| 7,877,909 | B1 | 2/2011 | Hagen et al. | |
| 7,894,935 | B1 | 2/2011 | Hagen et al. | |
| D645,121 | S | 9/2011 | Fukasawa | |
| 8,050,796 | B1 | 11/2011 | Hagen et al. | |
| D668,714 | S | 10/2012 | Zindl | |
| D677,322 | S | 3/2013 | Zindl | |
| 8,402,890 | B2 | 3/2013 | Faber | |
| 8,408,126 | B2 | 4/2013 | Faber | |
| 8,413,357 | B1 | 4/2013 | Hagen et al. | |
| 9,227,450 | B2 * | 1/2016 | Faber | B41K 1/36 |
| 9,354,630 | B2 | 5/2016 | Sukhman | |
| 9,475,326 | B2 | 10/2016 | Petersen | |
| D803,307 | S | 11/2017 | Riegler et al. | |
| 2001/0049669 | A1 | 12/2001 | Ito et al. | |
| 2003/0150343 | A1 | 8/2003 | Koneczny | |
| 2005/0066828 | A1 | 3/2005 | Wei | |
| 2006/0000374 | A1 * | 1/2006 | Faber | B41K 1/40 101/334 |
| 2006/0162596 | A1 | 7/2006 | Faber | |
| 2006/0185539 | A1 * | 8/2006 | Faber | B41K 1/40 101/333 |
| 2007/0272099 | A1 | 11/2007 | Pointl | |
| 2008/0087180 | A1 * | 4/2008 | Ameshofer | B41K 1/36 101/334 |
| 2009/0255427 | A1 | 10/2009 | Faber | |
| 2009/0301327 | A1 * | 12/2009 | Nelson | B41K 1/40 101/333 |
| 2010/0031835 | A1 | 2/2010 | Faber | |
| 2010/0263561 | A1 * | 10/2010 | Faber | B41K 1/40 101/334 |
| 2011/0277647 | A1 * | 11/2011 | Zindl | B41K 1/006 101/334 |
| 2013/0291744 | A1 * | 11/2013 | Anthony | B41K 1/10 101/333 |
| 2015/0181033 | A1 * | 6/2015 | Keller | H04L 65/1016 455/404.1 |
| 2016/0325381 | A1 | 11/2016 | Pinot et al. | |
| 2016/0361934 | A1 | 12/2016 | Riegler et al. | |
| 2016/0361935 | A1 | 12/2016 | Sillipp et al. | |
| 2016/0361936 | A1 | 12/2016 | Zehetner et al. | |
| 2016/0368297 | A1 | 12/2016 | Scharinger et al. | |

FOREIGN PATENT DOCUMENTS

| | | |
|---|---|---|
| AT | A50473/2015 | 6/2015 |
| AT | A50474/2015 | 6/2015 |
| AT | A50475/2015 | 6/2015 |
| AT | A50478/2015 | 6/2015 |
| CA | 2717256 | 11/2011 |
| CN | 301153224 | 3/2010 |
| CN | 304057436 | 2/2017 |
| CN | 304057437 | 2/2017 |
| DE | 202010007577 U | 8/2010 |
| EP | 0459969 | 12/1991 |
| EP | 0804344 B1 | 9/1998 |
| EP | 2384283 B1 | 11/2011 |
| EP | 001922865-0001 | 2/2012 |
| EP | 2591921 B1 | 5/2013 |
| EP | 2594406 | 5/2013 |
| EP | 002716431-0001 | 1/2017 |
| EP | 002716431-0011 | 1/2017 |
| EP | 002904854-0007 | 1/2017 |
| JP | D1546014 | 3/2016 |
| WO | 1999064246 | 12/1999 |
| WO | 2004085110 | 10/2004 |
| WO | 2006029422 | 3/2006 |
| WO | 2006079129 | 8/2006 |
| WO | 2006079131 | 8/2006 |
| WO | 2010085828 | 8/2010 |
| WO | 2011056345 | 5/2011 |
| WO | 2011151604 | 12/2011 |
| WO | 2014113833 | 7/2014 |
| WO | 2014/172738 A1 | 10/2014 |
| WO | 2014172738 | 10/2014 |
| WO | 2015103654 | 7/2015 |
| WO | 2016/197172 | 12/2016 |
| WO | 2016197170 | 12/2016 |

OTHER PUBLICATIONS

Co-Pending Design U.S. Appl. No. 29/567,664 entitled, "Hand Stamp" to Riegler et al., filed Jun. 10, 2016.

Co-Pending Design U.S. Appl. No. 29/567,665 entitled, "Stamp Pad" to Riegler et al., filed Jun. 10, 2016.

Co-Pending Design U.S. Appl. No. 29/567,666 entitled, "Hand Stamp" to Riegler et al., filed Jun. 10, 2016.

NPL02—Registered Community Design No. 002716431, registered Community design for hand stamp and pad, Jun. 10, 2015, 86 pages.

NPL03—Written Opinion for PCT/AT2015/050003 dated Sep. 11, 2015. (publication No. WO2015103654).

NPL04—International Search Report for PCT/AT2015/050003 dated Dec. 11, 2015. (publication No. WO2015103654).

NPL05—Registered Community Design No. 002904854, registered Community design for hand stamp and pad, Dec. 10, 2015, 23 pages.

NPL06—Amazon. <URL: https://www.amazon.com/dp/B01MQDH576?psc=1.> Nov. 3, 2016. Self-inking stamp.

NPL07—Amazon. <URL: http://a.co/3GHpXYC.> Feb. 12, 2011 Self-inking stamp.

NPL08—Amazon. <URL: https://www.amazon.com/Replacement-TRODAT-Printy-I nkinguStamps/dp/BOOFB70JEO/ref=sr_ 1_ 1 ?ie=UTF8&qid=1496770907&sr=8-1 &keywords=Replacement+Ink+Pad.> Feb. 11, 2012. Replacement Ink Pad.

NPL09_Universal Laser Systems, Inc., "The Turnkey Laser Personalization and Identification Program," 2000.

Notice of Allowance for U.S. Appl. No. 29/567,664 dated Jul. 12, 2017.

(56) References Cited

OTHER PUBLICATIONS

Non Final Office Action for U.S. Appl. No. 29/567,665 dated Jun. 29, 2017.
Non Final Office Action for U.S. Appl. No. 29/567,666 dated Jun. 30, 2017.
Non Final Office Action for U.S. Appl. No. 15/177,072 dated Mar. 27, 2017.
Non Final Office Action for U.S. Appl. No. 15/177,078 dated Mar. 31, 2017.
Non Final Office Action for U.S. Appl. No. 15/177,091 dated Mar. 31, 2017.
NPL10—Communication for U.S. Appl. No. 29/567,665 dated Jan. 3, 2018.
Final Office Action for U.S. Appl. No. 15/177,072 dated Oct. 11, 2017.
Advisory Action for U.S. Appl. No. 15/177,072 dated Dec. 27, 2017.
Final Office Action for U.S. Appl. No. 15/177,078 dated Oct. 20, 2017.
Notice of Allowance for U.S. Appl. No. 15/177,100 dated Oct. 19, 2017.

* cited by examiner

STAMP AND STAMPING INSERT

PRIORITY CLAIM

This application claims priority to Austrian Patent Application No. A50478/2015 entitled "Höhenverstellung" filed on Jun. 10, 2015, all of which is incorporated by reference herein.

BACKGROUND OF THE INVENTION

1. Field of the Invention

The invention relates to a stamp and a stamping insert.

2. Description of the Relevant Art

From EP 0804344 B1, a stamping device with top inking, also known as self-inking stamp, is known that has a receiving frame made of metal for a stamping insert, which is guided in lateral parts of the receiving frame. The receiving frame supports a bottom part made of plastic. The stamping insert is adjustable via a reversing mechanism from a resting position, in which ink is adsorbed from a cushion placed in an ink pad, to an imprinting position against a spring force by a bow-shaped top part. The bow-shaped top part in turn comprises a metal reinforcement bracket on the inside. Furthermore, in the middle of the bow-shaped top part and in the center of the bottom part, on both sides of the bow spring elements are positioned for returning the top part to the resting position. For fixation of the top part relative to the bottom part, latching elements are arranged in the bottom part that engage in a recess on the outside of the bow-shaped top part.

Such a design of a self-inking stamp by the Applicant differs from the prior art, such as U.S. 2009/0255427 A, AT 501318 B and DE 202010007577 U, by the absence of a central strut between the top part and bottom part. In the prior art, the central strut accommodates the spring element, so that on the lateral parts of the bow-shaped top part now no spring elements are arranged anymore. In this prior art, the element cannot be described as a bow-shaped top part either, since the central strut forms a central bar to the two lateral bars. The essential disadvantage of a self-inking stamp with central strut is that there is no space for integrating a viewing window, and thus the replica of the stamp image is arranged with an offset and extends to the lateral surface of the bottom part.

The stamping insert with attached mounted band unit used for the above-mentioned documents is designed so that the band unit is adjusted in terms of its height to the text plate via at least two adjustment elements, in particular screws. The disadvantage here is that a mutually independent adjustment of the adjustment must be carried out, so very often the mounted band unit is not aligned parallel to the text plate. This can result in inconsistent printing images.

SUMMARY

An objective of the present invention is to provide a stamp, a stamping insert, a printing plate for a stamping insert, in which improved adjustment of the height is achieved for the stamp bands. At the same time, simple customization and assembly of the text plate are to be provided. Another object is to allow customization of the stamp as late as possible.

Objectives of the invention are achieved by a stamp such that at the stamping insert a height adjustment element is provided for the mounted band unit and/or a text plate carrier, and the height adjustment element is connected or operatively connected, respectively, with a single adjustment element, in particular a preferably centrally provided set-screw, and the mounted band unit and/or text plate carrier is attached to the text plate carrier and/or mounted band unit via the height adjustment.

The advantage here is that thus a very simple height adjustment using only one adjustment element has been created. This allows a very rapid adaptation of the mounted band unit by simple turning of the adjustment element. The lateral arrangement of the adjustment element also substantially increases accessibility, as it is now possible to adjust the mounted band unit both in the resting position and in the stamping position. To adjust the height of the mounted band unit, preferably the stamp with the text plate is set to the stamping position, so the stamp makers or user can then adjust the mounted band unit by simply rotating the adjustment element.

Another advantageous embodiment is that thus always a parallel adjustment of the mounted band unit via the height adjustment element is carried out, whereas in the prior art with two set-screws very frequently an oblique orientation of the mounted band unit results, whereby stamping quality is impaired. It is essential for the height adjustment that the mounted band unit and text plate carrier are adjusted in relation to each other in order to be able make an adjustment of the two, i.e., that the described embodiments can also be used for the adjustment of the text plate carrier with a fixed mounted band unit.

An embodiment is advantageous in which the mounted band unit is freely movably guided on the stamping insert via at least one, preferably two guide elements. The advantage here is that thereby easy height adjustment thanks to the freely movable bearing in vertical direction is possible, while at the same time horizontal shifting of the mounted band unit is prevented.

A further embodiment is advantageous, in which the adjustment element is formed by a set-screw and this is provided preferably in the center, particularly in the central region of the height adjustment element, in particular of a central bar. This ensures that the mounted band unit can be height-adjusted by simply turning the set-screw. The accessibility of the set-screw is also improved by the central positioning. But it is also possible that the set-screw is replaced by an equivalent means, in particular an adjusting lever, which is e.g. simply twisted to height-adjust the mounted band unit.

In an advantageous embodiment the height adjustment element comprises a slide track with an angular course. This ensures that the mounted band unit is height-adjusted along the angular slide track when the height adjustment element is moved horizontally over the adjustment element. By appropriate selection of the angle of the slide track, the adjustment height and sensitivity can be influenced, i.e. at a shallower angle of the slide track lower height adjustment is possible than at a steeper angle. Thus, depending on the design of the stamping insert, an appropriate height adjustment element with a corresponding mounted band unit can be used.

However, in another advantageous embodiment the height adjustment element comprises a guide track for horizontal guidance. This ensures that upon adjustment via the angular slide track a secure horizontal guide is provided to avoid tilting of the height adjustment element. Of course, the height adjustment element can also be used with the angular slide track alone.

In an advantageous embodiment the mounted band unit is attached on and adjustable via the height adjustment element. Thereby simple and rapid mounting is enabled, and no additional means of fixation need to be employed.

In one configuration it is advantageous that the height adjustment element has a bow-shaped design, wherein preferably on both sides of a central bar (38) the angular slide track (36) and the horizontal guide track (37) are arranged. This ensures a parallel shifting of the mounted band unit to the text plate.

An objective of the invention is also achieved by a stamping insert in which the text plate carrier comprises a height adjustment element for the mounted band unit, and the height adjustment element is connected to or in operative connection with an adjustment element, in particular a preferably centrally provided set-screw, where said mounted band unit is fastened via the height adjustment element to the text plate carrier and/or mounted band unit.

The advantage here is that such a design allows simple and rapid adjustment in all positions, especially in the stamping position. At the same time, thanks to the design of such a stamping insert it can be inserted into a wide variety of stamps such as self-inking stamps, plastic self-inking stamps. Preferably, the adjustment element is arranged laterally centrally below the adjustment elements for the stamp bands in order to achieve optimum accessibility.

In an advantageous embodiment, the stamping insert can be subsequently inserted with the mounted band unit into a stamping component of a stamp and this is designed for parallel height adjustment of the mounted unit, in particular a self-inking stamp. This ensures that the stamping component can be manufactured independently of the stamping insert to be inserted, allowing customization as late as possible. This is possible insofar as for the height adjustment of the mounted band unit all parts or components are arranged on the stamping insert, so that it can be used independently of the stamp.

Further embodiments are described in claims 10 to 15. The resulting benefits can be taken from the description, in particular from the advantages of the stamp.

An object of the invention is achieved by a stamp, in which at least one adjustment element is provided on the mounted band unit, which is accessible or operable, respectively, in a resting position or stamping position from the front or rear.

The advantage here is that the two stamping positions are available for a stamp, and thus no additional positions are needed for adjustment. At the same time, the stamp can be easily set up, and adjustment can be made via the front or rear. To this end, the stamp is preferably compressed, then an adjustment can be made easily over the front or rear sides, depending on where the adjustment is appropriate.

In another advantageous embodiment, the adjustment element is arranged parallel to the text plate mounting surface. This ensures that in the corresponding positions, especially in the resting position or in the stamping position, the adjustment element can be reached, where the stamp may be set up.

In another advantageous embodiment, the adjustment element is designed to adjust the height of the mounted band unit. This allows adjustment of the mounted band unit to the text plate to be made, so that various text plates or mounted band units can be used.

Finally, in another advantageous embodiment the height is adjusted preferably via an angular slide track. This allows a simple design, so the stamping insert is as compact as possible.

The invention is described hereinafter in the form of exemplary embodiments, wherein attention is drawn to the fact that the invention is not limited to the exemplary embodiments or solutions represented and described.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
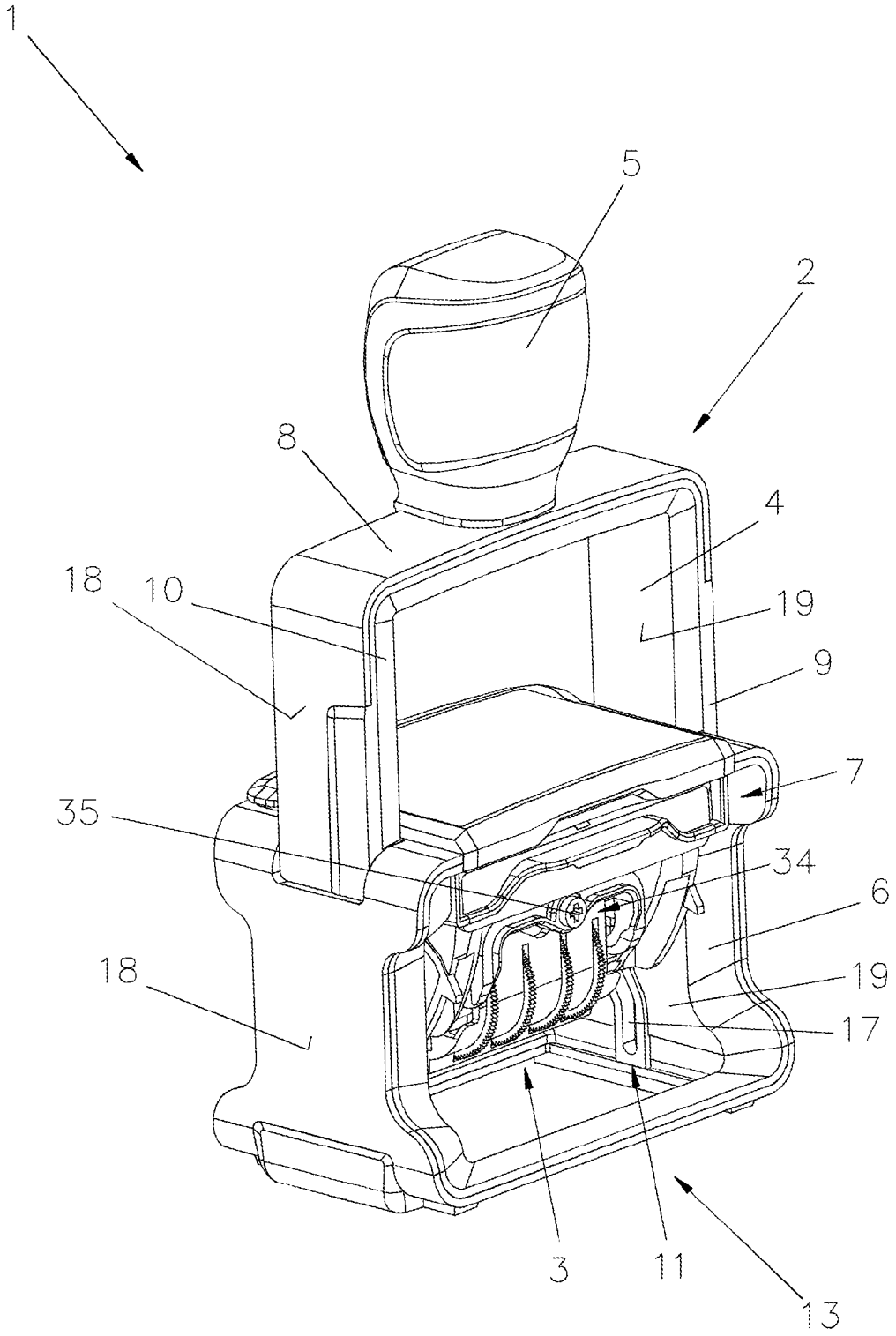
FIG. 1—schematic illustration of a stamp, particularly a self-inking stamp, in a resting position; simplified, for illustrative purposes only.
Figure 2:
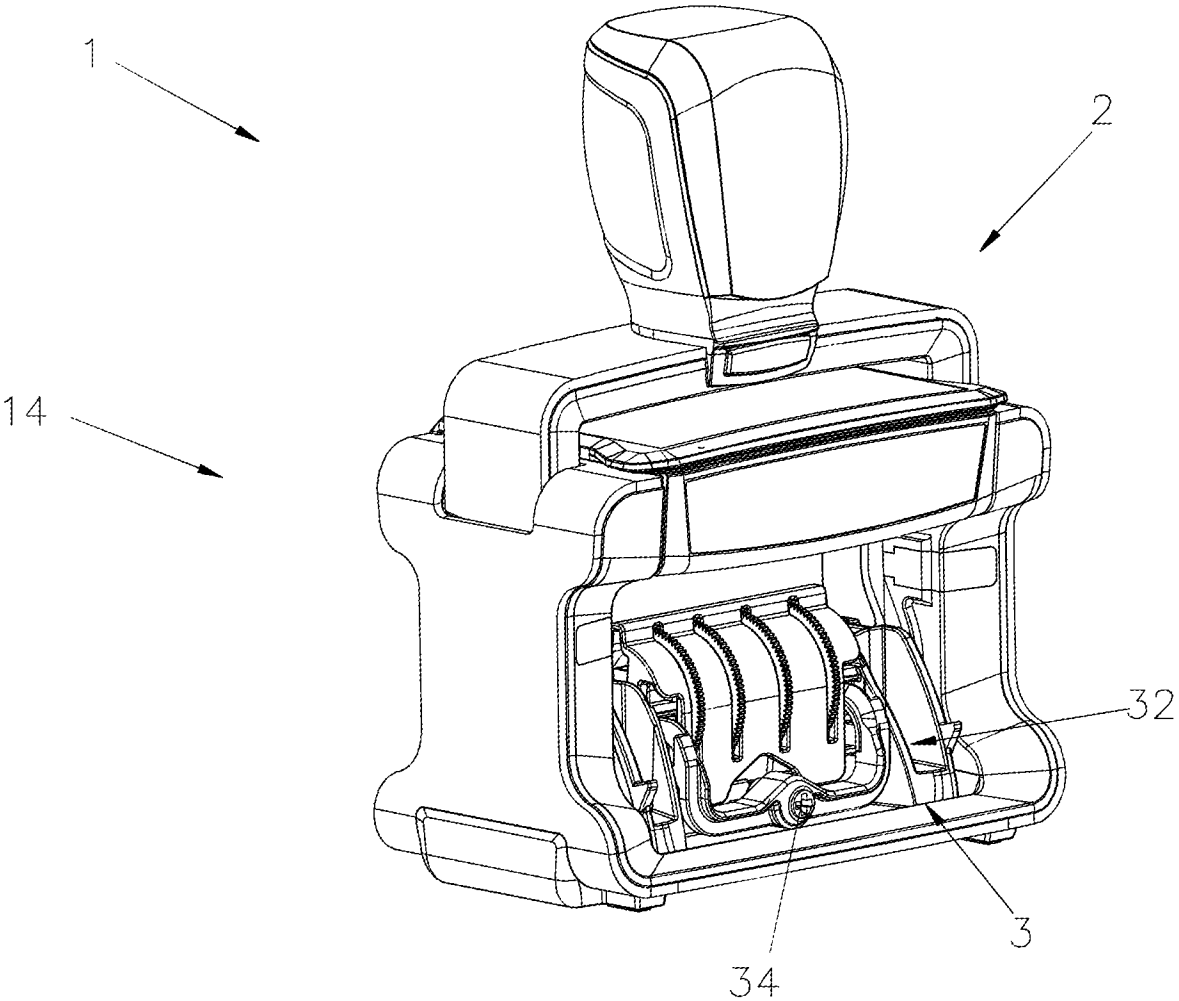
FIG. 2—schematic illustration of the stamp in a printing or printing position, respectively; simplified, for illustrative purposes only.
Figure 4:
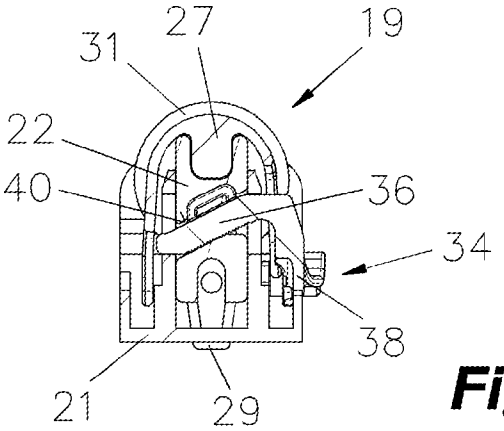
FIG. 4—sectional illustration of the embodiment according to FIG. 3; simplified, for illustrative purposes only.
Figure 3:
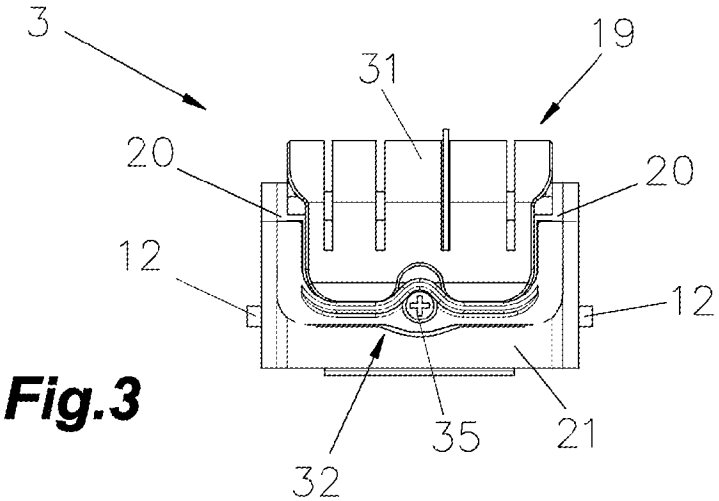
FIG. 3—front view of a stamping insert with inserted mounted band unit and central height adjustment; simplified, for illustrative purposes only.
Figure 5:
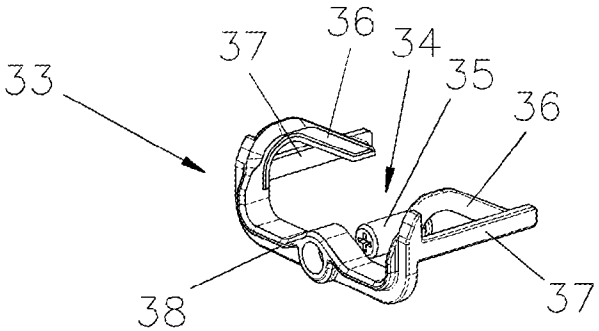
FIG. 5—schematic illustration of a height adjustment element for the mounted band unit; simplified, for illustrative purposes only.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third die electrically connected to the module substrate" does not preclude scenarios in which a "fourth die electrically connected to the module substrate" is connected prior to the third die, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process affects another process or structure without the involvement of an intermediate step or component.

Embodiments

It should be stated by way of introduction that, in the individual embodiments, the same parts are provided with the same reference numbers or same component designations, wherein the disclosures contained in the entire description can, by analogy, be transferred to same parts with same reference numbers or same component designations. The position details selected in the description, such as, e.g., top, bottom, lateral, etc., relate to the figure described, and in the event of a change of position, they are to be transferred to the new position by analogy. Individual features or feature combinations from the exemplary embodiments shown and described may also represent independent inventive solutions.

In FIGS. 1-6, a stamp 1, in particular a self-inking stamp 1 is shown, comprising at least one stamping component 2 and one stamping insert 3.

The stamping component 2 consists at least of a top part 4 having a handle element 5 and a bottom part 6 with a cushion-receiving element 7. The top part 4 is preferably bow-shaped and comprises one longitudinal bar 8 and two lateral elements 9,10, where the lateral elements 9,10 are guided in the bottom part 6. The stamping insert 3 is connected via a reversing mechanism 11, in the bottom part 6 connected so as to move synchronously to the top part 4 via a shaft 12 and a swivel pin 12, so that the stamping insert 3 in the bottom part 6 can move from a resting position 13, according to FIG. 1, into a printing or stamping position 14, according to FIG. 2, upon actuation of the top part 4, in particular in particular upon exertion of pressure on the handle element 5. Of course, a different design is possible in which the top part 4 is cap-shaped and during a stamping operation receives the bottom part 6 in its interior, as this is the case in plastic self-inking stamps, e.g. the "Printy4.0" by the company Trodat. In the resting position 12, a text plate 15 mounted on the stamping insert 3 abuts against an ink pad soaked with stamp ink 16 in the cushion-receiving element 7, wherein during a stamping process for producing a stamp impression the stamping insert 3 with the text plate 15 is adjustable or is adjusted via the reversing mechanism 11 from the resting position 13 by a rotational movement into the stamping position 14, i.e., the stamping insert 3 is rotated around the shaft 12, for which the reversing mechanism 11 serves, in which along a predetermined slide track 17 a rotation of the stamping insert 3 is performed. Such reversing mechanisms 11 and rotational movements are known from self-inking stamps of this type 1, so they will not be described in more detail. It is merely pointed out that in the stamp 1 according to the invention a rigid slide track 17 is shown, but alternatively a movable slide track (not shown) may be employed. Of course, an equivalent design of the components with a so-called central strut, as is known from the prior art, would also be possible, i.e. the same or equivalent parts are used, but an additional central strut is used, in which a spring for resetting into the resting position 13 is arranged, where in the illustrated stamp 1 in the lateral bar 8,9 and bottom part this 6 is arranged.

In the illustrated stamp 1, a combination of metal parts 18 and plastic parts 19 is used, where the metal parts 18 are arranged to be externally visible. The metal parts are thereby pushed over the plastic parts and latch via a latch connection (not shown), so that upon pressurisation the metal parts 18 absorb some of the pressure, i.e., the metal parts 18 support the plastic parts 19 in their rigidity, so that no bending of parts is possible and thus an optimum impression with very high print quality is achieved.

The advantage for the use of a metal/plastic combination is that the plastic parts can be dimensioned smaller in terms of wall thickness, because the metal parts 18 also absorb a part of the acting forces.

The design of the stamp 1 shown is in the form of a kit for the stamping component 2, i.e., the same parts of the stamping components 2 are used for the various versions of the stamp 1, such as self-inking stamp 1 with a text plate as well as self-inking stamp 1 with a mounted band unit 19, where customization takes places only by insertion of the stamping insert 3.

To this end, the mounted band unit 19 can be inserted into the stamping insert 3, which is preferably guided on two sides by guide elements 20 on the stamping insert 3, in particular a text plate carrier 21. The mounted band unit 19 comprises a base body 22 and a termination element 23 for this purpose. The base body 22 has a preferably circular receiving element 24 and a so-called bridge 25. On the receiving element 24 a plurality of belt drives 26 consisting of an adjustment wheel 27 and a movement-coupled actuator 28 are provided. On the actuator 27 of each belt drive 26 a stamp band 29 is arranged, wherein in the illustrated embodiment the mounted band unit 19 is designed as a date, and thus four stamp bands 29 (two day bands, one month band and a year band) and four belt drives 26 are assembled on the receiving element 24. The stamp bands 29 are led via the bridge 25, which is preferably designed to be adjustable, so that an appropriate tension of the band can be set up and adjusted. To prevent slipping of the belt drives 26 off the base body 22, subsequently the termination element 23 is attached, which can be done for example via a latching connection. Preferably, the termination element 23 is only plugged on, as due to the installation on the stamping insert 3 the termination element 23 cannot slip off the base body 22 through the two guide elements 20, 21.

Preferably, at least the actuator 27 of the belt drive 26 is formed of a two-component injection-moulded element, wherein one surface 30 of the actuator 27 is formed from a material with high friction properties for reliable transport of the stamp band 29. The stamp band 29 itself has, on the side facing the actuator 27, a smooth or slightly roughened surface, so that a frictional connection for the transport of the stamp band 29 over the actuator 27 is provided. Thereby, a transport system for the stamp band 29 for the stamp 1, in particular a self-inking stamp, is created that consists of at least the belt drive 26, which [in turn] consists of an adjustment element 27 with a movement-coupled actuator 28 for the stamp band 29 and the so-called bridge 25 for deflecting and positioning the stamp band 29 in the imprinting area, wherein the actuator 28 and the bridge 25 are mutually positioned in such a manner that the stamp band 29 is held and tensioned by them. Of course, it is also possible that the surface 30 comprises a structure that engages in a corresponding structure on the stamp band 29, where thanks to the two-component injection-moulded parts high friction is formed, because the materials of the surface 30 are coordinated with the stamp band material to ensure reliable transport.

In the illustrated embodiment, a belt cover 31 is provided which is simply plugged on, as known from the prior art, in particular from AT 503 570 B or AT 504 428 B, so it is not discussed in more detail.

Figure 6:
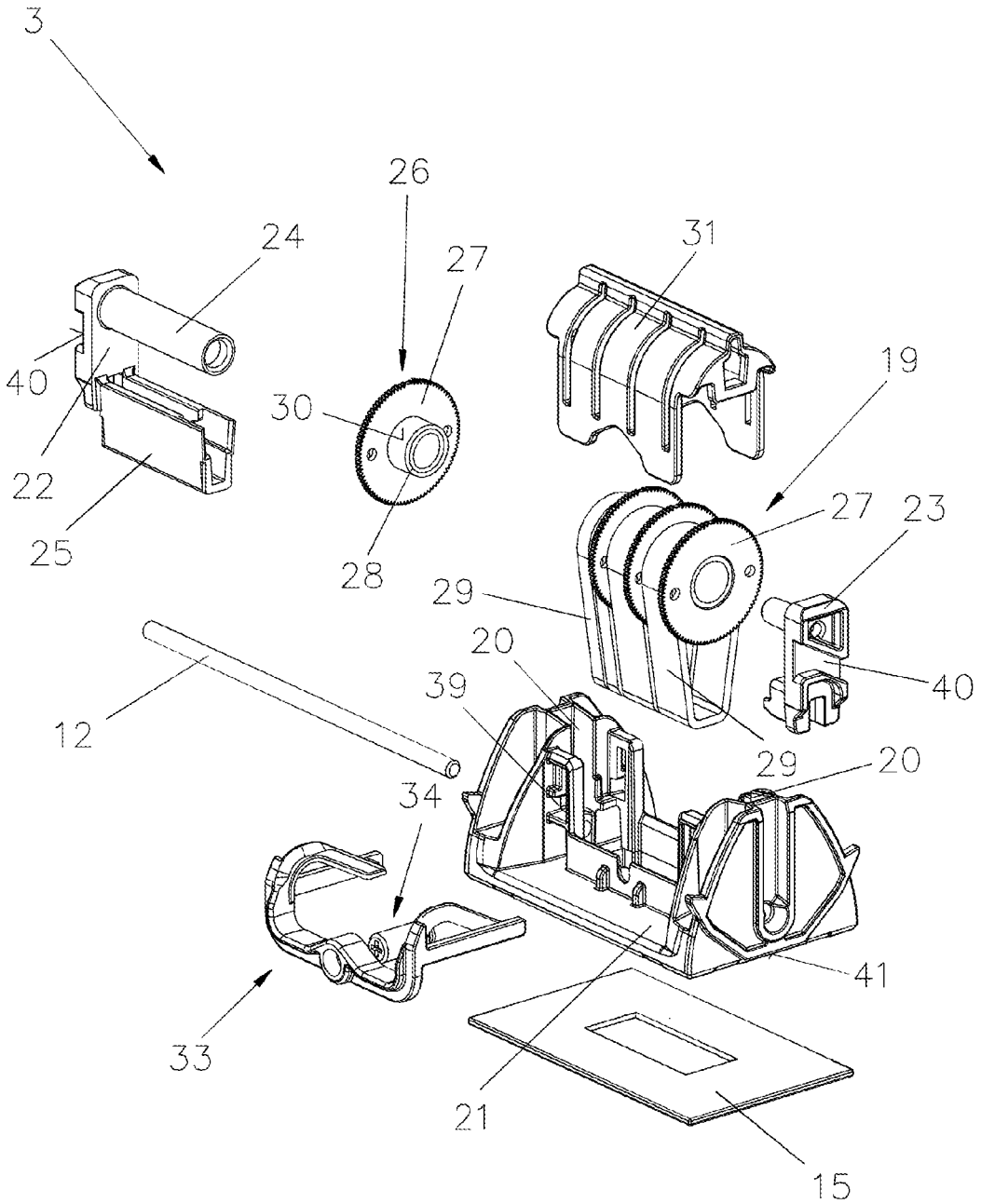
FIG. 6—exploded view of the stamping insert; simplified, for illustrative purposes only.

In the stamping insert according to the present invention 2, now a central height adjustment 32 is provided for the mounted band unit 19 to allow easy and rapid adjustment of the mounted band set unit 19. As a central element of this, here a height adjustment element 33, as shown in FIG. 6, is arranged, which is simultaneously used for guidance and height adjustment 32 of the mounted band unit 19. The height adjustment element 33 is connected to an adjustment element 34, in particular with a preferably centrally provided set-screw 35, or is in operative connection with this, respectively, so that the height adjustment element 33 is shifted by actuation of the adjustment element 34. Preferably, the height adjustment element 33 is a slide track with an angular course 36 and a guide track with a horizontal course 37, where in the illustrated embodiment two slide tracks 36 and two guide tracks 37 are laterally arranged or formed on a central bar 38. The guide tracks 37 engage in guides 39 on the lateral guide elements 20, 21 of the stamping insert 3 and the slide track 36 into corresponding guides 40 on the base body 22 and termination element 23 of the mounted band unit 19. This ensures that the mounted band unit 19 is supported over the angular slide track 36 movably for height adjustment 32, and this is simultaneously led over the guide track 37 in the horizontal direction to the stamping insert 3.

To move the height adjustment element 33, it is necessary to actuate the adjustment element 34, whereby the height adjustment element 33 is shifted horizontally, i.e. the central bar 38 is in operative connection with the set-screw 35, so that this is screwed or unscrewed by rotating the set-screw 35, thus the central bar 38 with the guide tracks 36 and guide tracks 37 is also moved horizontally. As the mounted band unit 19 is guided vertically in the guide elements 20, 21, this cannot be moved horizontally, but slides vertically up or down along the angular slide track 36, depending on the rotation of the set-screw.

In the height adjustment according to the present invention 32 it is now operated with only a single adjustment element 34, in particular a single set-screw 35, whereby a parallel shift of the entire mounted band unit 19 relative to the text plate 15 is performed or obtained via the angular slide track 36. This makes it possible for the first time that in a stamp 1 with a reversing mechanism 11 the height for the mounted band unit 19 can be adjusted with a single set-screw 35 only. The central height adjustment 32 is located directly on the stamping insert 3, so that it also performs a rotation during a stamping operation. Another advantage lies in the fact that access to the adjustment element 34, in particular the set-screw 35, takes place laterally, so that in the resting position 13 and in the stamping position 14 the adjustment element 34 can be easily reached, whereas in the prior art this is not the case, because the usual two set-screws are arranged from the top, i.e. in the vicinity of the adjustment wheels 27, so that access is possible only in the resting position 13 from the bottom or in a half-stamping position from the side of the stamp 1.

Of course, it is possible that the adjustment element 34 is not arranged in the center of the central bar 38, but the adjustment element 34 may be positioned in the lateral regions as well.

Furthermore, however, it is also possible that the previously described embodiment can be built conversely, i.e. that it is not the mounted band unit 19 that is adjusted in height, but the text plate 15 or text plate carrier 21 is adjusted in height via the adjustment element 34. In the solution according to the present invention the support plate 15 and the text plate carrier 21, in particular a text plate mounting surface 41 and mounted band unit 19 are mutually adjustable in height, so that appropriate adjustment can be performed. This is necessary because different mounted band units 19 with stamp bands 29 of different thicknesses or various text plates 15 of materials having different thickness, particularly rubber, are used, so appropriate adjustment is necessary.

As described, in the first exemplary embodiment the adjustment is made via only one adjustment element 34, in particular a centrally provided set-screw 35, whose accessibility is provided over the longer free side of the stamp 1, hence a front 42 or rear 43, in the resting position 13 as well as in the stamping position 14. This accessibility is important insofar as it is now for the first time possible to bring the stamp 1 into the stamping position 14 according to FIG. 2, and to make the adjustment to the same, i.e., for example, the stamp 1 is brought into the stamping position 14 and preferably locked, whereupon via the front or rear 42, 43 the mounted band unit 19 is adjusted, for which purpose the stamp 1 can be placed on a surface and subsequently the mounted band unit 19 is added. Thus, when the stamp 1 is set up on a table or surface, the stamp manufacturer or user receives a feedback during adjustment, as the mounted band unit 19 is also pressed against the table or the surface, so that a corresponding stop is present and therefore the stamp makers or users know that now both components, i.e. the text plate 15 and the mounted band unit 19, are at the same level.

Figure 7:
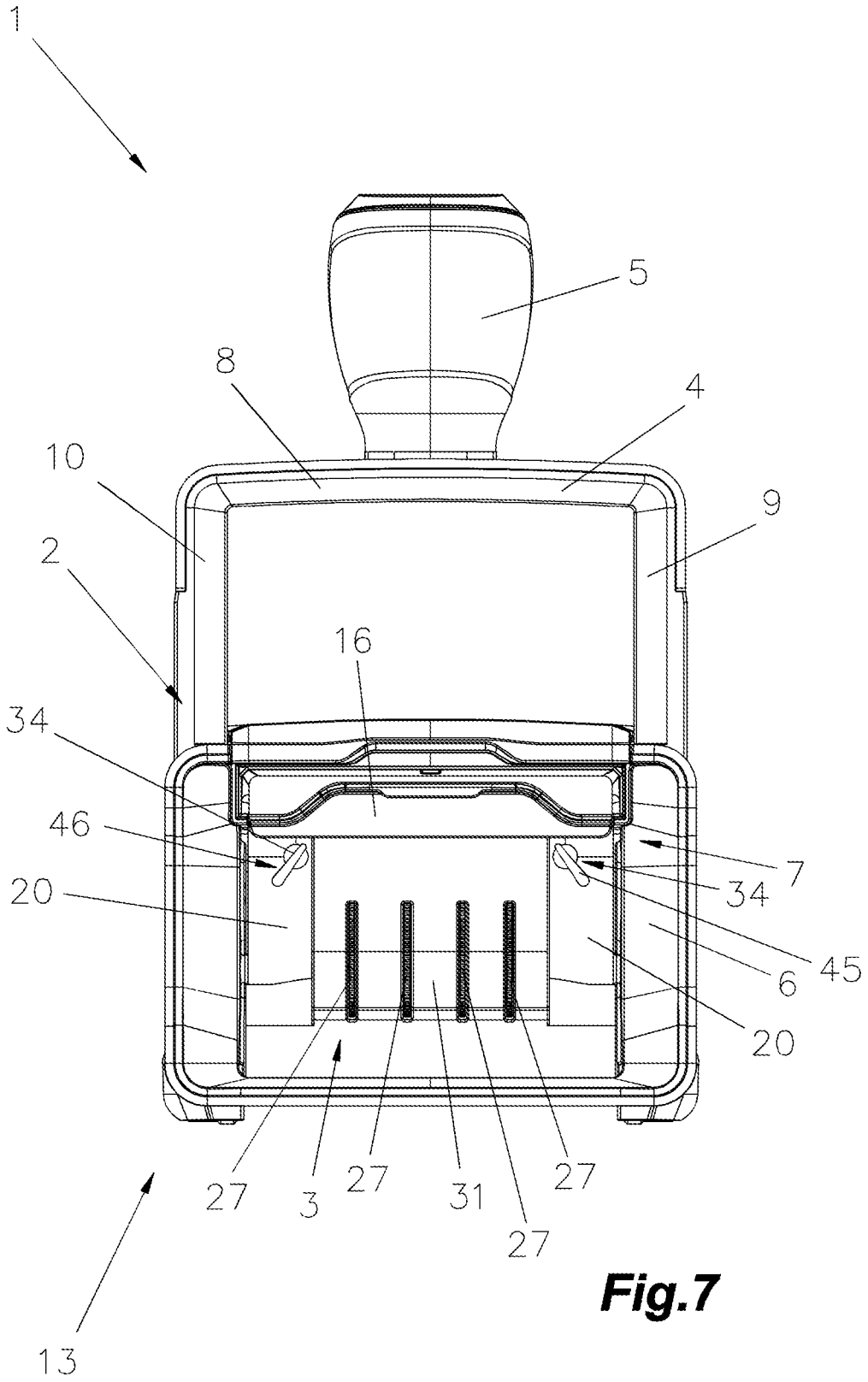
FIG. 7—rear view of the stamp with two adjustment elements; simplified, for illustrative purposes only.
Figure 8:
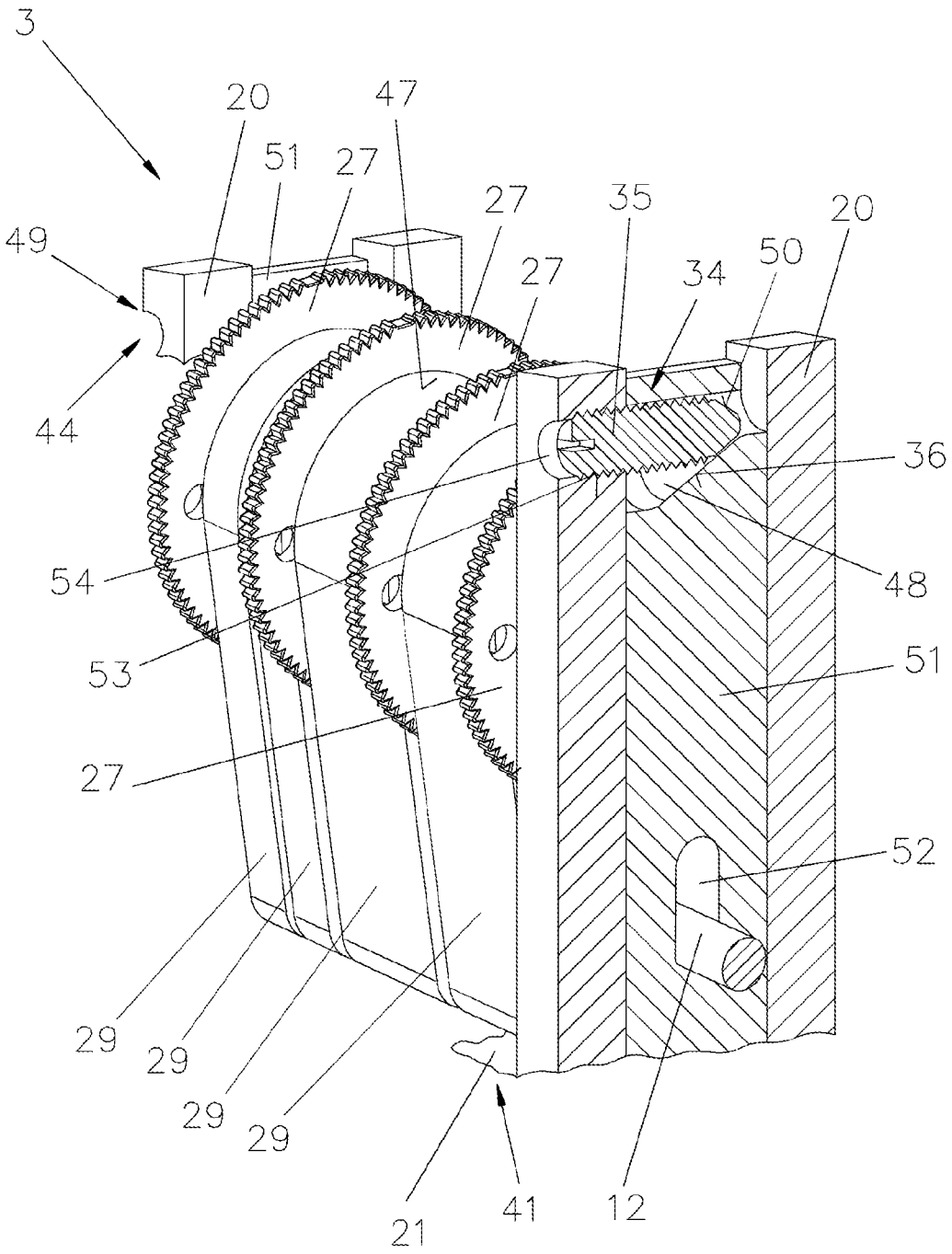
FIG. 8—a further exemplary embodiment of a height adjustment with two adjustment elements; simplified, for illustrative purposes only.

In FIGS. 7 and 8, now a further exemplary embodiment is shown, in which the height is adjusted by means of several, in particular two adjustment elements 34, 44, which preferably are independently adjustable. This corresponds to a similar structure as known from the prior art, where in the prior art the adjustment always takes place via the setting screws from above, i.e. on the upside in the direction of the stamp bands 29 of the mounted band unit 19, while in the new adjustment system according to the present invention the adjustment is performed laterally, i.e. offset by 90[°] to the alignment of the stamp bands 29.

Here an adjustment element 34, 44 is arranged on either side of the mounted band unit 19, where these are now designed as control levers 45, 46, so that for the adjustment no additional tools such as screwdrivers are required. Of course, it is also possible to use the set-screws 35 instead of the lever 45, 46. Preferably, the two adjustment elements 34, 44 are not in operative connection here, but each can independently effect a height adjustment of the mounted band unit 19 on either side of the mounted band unit or text plate mounting surface 41, i.e., the height of the mounted band unit 19 is adjusted via the two adjustment elements 34, 44, where these are gradually raised or lowered on either side of the mounted band unit 19 relative to the text-plate mounting surface 41, or vice versa. With such a configuration with independent adjustment elements 34, 44 it is possible that the mounted band unit 19 can now be aligned askew, particularly at an angle, relative to the text plate mounting surface 41. This is advantageous whenever a mounted band unit 19 comprises differing stamp bands 29, or the manufacturing tolerances of the stamp bands 29 are very high, since then a corresponding oblique orientation can be made.

In contrast to the prior art now for the first time the adjustment elements 34, 44 are [actuated] via the front or rear 42, 43 of the stamp 1 in the resting position 13 or in the stamping position 14, so that very easy accessibility in the existing positions is given and no additional adjusting position is required, in which the stamp 1 is only half-compressed so that accessibility to the top of the mounted band unit 19 is possible from the front 42 and rear 43, for which purpose preferably a dedicated locking position is provided, as implemented in the prior art, since in the prior art the adjustment element are arranged and accessible on the upside.

In the exemplary embodiment of FIG. 7, the raising and lowering of the mounted band unit 19 can be carried out via a spindle, eccentric, or other lifting mechanism that executes a translation of the horizontal rotary movement into a vertical lifting movement, where accessibility is given in the resting position 13 and/or in the stamping position 14 from the front 42 or rear 43 or both sides.

FIG. 8 shows an exemplary embodiment where the adjustment elements 34, 44 in turn are provided in the form of an angular slide track 36. Here, the adjustment elements 34, 44 are now arranged above or within the area of an upside 47 of the mounted band unit 19 in the guide elements 20, which are, however, in turn arranged parallel to the text-plate mounting surface 41, thus rotated by 90° relative to the stamping direction of the mounted band unit 19. The angular slide track 36 is now located in a channel 48 into which the adjustment element 34, 44 engages. The adjustment element 34, 44 is formed as a set-screw 35, 49, where the set-screws 35, 49 have a corresponding angular surface 50. Thus it is possible that by turning in the set-screws 35,49 or turning out the set-screws 35,49 the mounted band unit 19 is adjusted in height, the mounted band unit 19 being connected for this purpose to a height adjustment element 51, which is guided in the guide elements 20 and in which the channel 48 is arranged. To enable height adjustment of the mounted band unit 19, the height adjustment element 51 comprises a slot 52 for the shaft 12.

Of course it is possible that the channel 48 with the angular slide track 36 is arranged directly on the mounted band unit 19, so that the mounted band unit 19 is inserted in the guide elements 20. Then, the set-screws 35, 49 are screwed through a threaded 53 bore 54 into the guide element 20, so that the set-screws 35, 49 engage in the channel 48.

Preferably, the mounted band unit 19 is supported by a spring element (not shown), so that the mounted band unit 19 is always pressed in a defined direction. This ensures that during the adjustment via the adjustment elements 34, 44, the mounted band unit 19 is pressed against the angular slide track 36, so that optimum displacement along the slide track 36 is possible. Embodiments with tension spring as well as with compression spring are possible.

Figure 9:
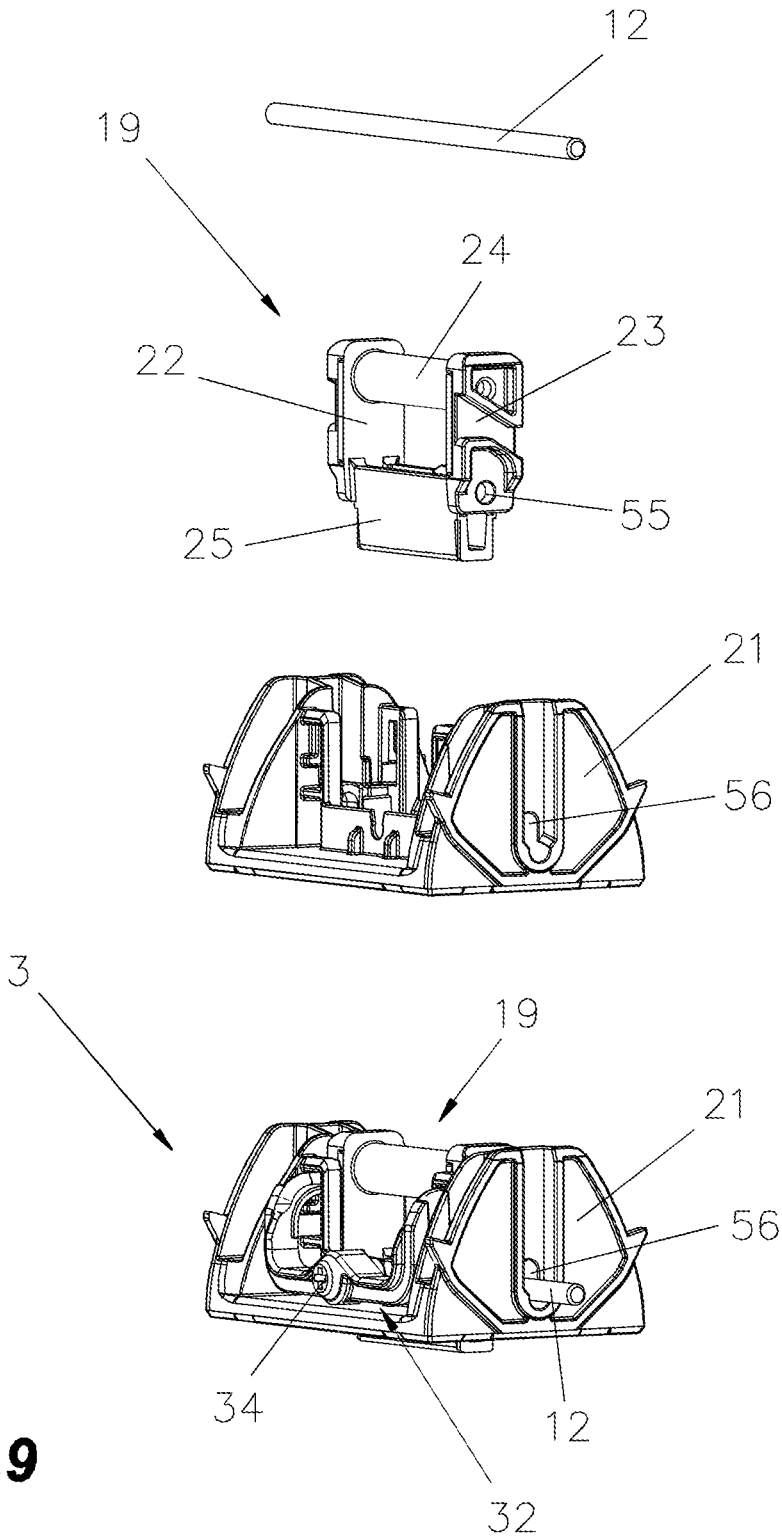
FIG. 9—exemplary embodiment with adjustment of the text plate carrier without mounted stamp bands; simplified, for illustrative purposes only.

In FIG. 9 a kind of exploded view of the main elements of an exemplary embodiment of an adjustment of the text plate carrier 21 with a central height adjustment 32 is shown, i.e. now the mounted band unit 19 is fixed, and upon actuation of the adjustment element 34 the text plate carrier 21 to the mounted band unit 19 is adjusted in height.

As can be seen now from the individual elements, the base body 22 and the termination element 23 comprise a bore 55 for the shaft 12 in the region of the bridge 25. Thus, the mounted band unit is fixed in the assembled state, since due to the bore 55 no displacement is possible anymore. In the embodiment described above, the mounted band unit 19, in particular the base body 22 and the termination element 23, are equipped with a slot for the height adjustment. A corresponding slot 56 is now placed on the text plate carrier 21, so that the entire text plate carrier 21 can be adjusted in height via the adjustment element 34 to the mounted band unit 19.

Figure 10:
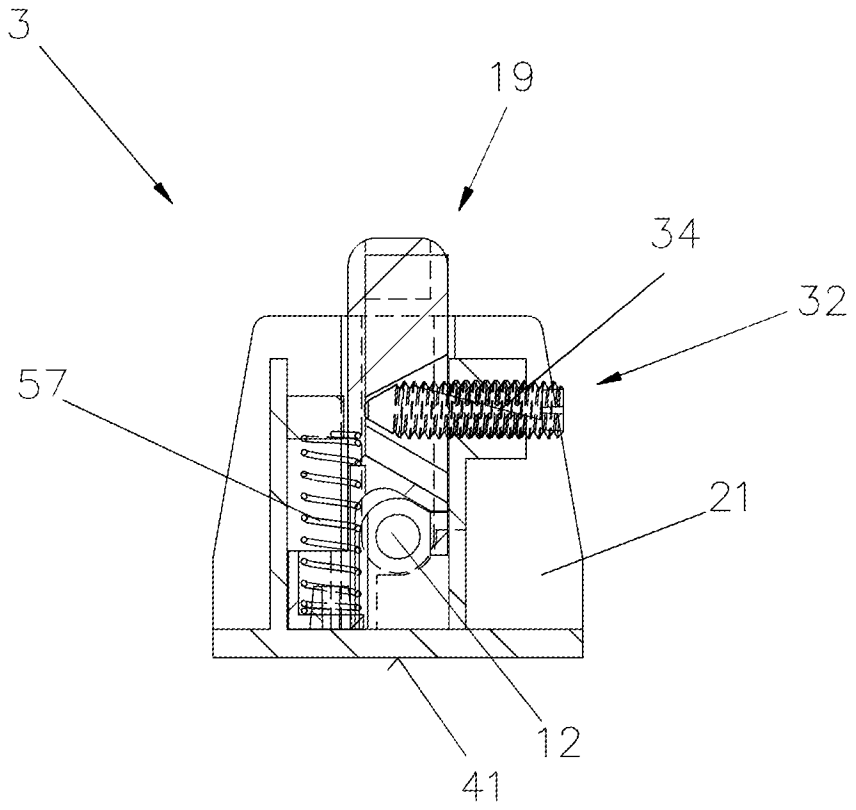
FIG. 10—exemplary embodiment with resiliently loaded mounted band unit; simplified, for illustrative purposes only.

In FIG. 10 an exemplary embodiment is shown, in which the mounted band unit 19 is resiliently mounted on the text plate carrier 21 of the stamping insert 3. For this purpose, a spring element 57 is arranged so that this presses the mounted band unit 19 into a defined direction, so a defined position of the mounted band unit 19 is always ensured.

In the embodiment shown here, a compression spring is used as a spring element 57 that presses the mounted band unit 19 in the direction of the text-plate mounting surface 41. As a result, now at the height adjustment 32 the mounted band unit 19 can be adjusted beyond the text plate 15 (not shown), as during a stamping process the mounted band unit 19 builds up an additional pressure on the spring element 57. Thus, the height adjustment 32 does not need to be performed precisely, as an independent adjustment is carried out via the spring element 57.

Of course, it is possible that also the embodiments described above can be equipped with a respective spring element 57. It is also possible that, with appropriate design, a tension spring can be used.

As a matter of form, it should finally be emphasised that, for the better understanding of the structure of the system 1 and its components and their constituent parts, the same have in part been represented not to scale and/or enlarged and/or reduced in size.

In addition, individual features or feature combinations from the various exemplary embodiments shown and described can inherently form independent inventive solutions or solutions according to the invention.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A stamp comprising at least one stamping component and one stamping insert with a mounted band unit, wherein the stamping component comprises a top part and a bottom part with a cushion-receiving element, wherein the stamping insert with the mounted band unit is connected such that the stamping insert and the mounted band unit move synchronously via a reversing mechanism in the bottom part to the top part, wherein in the resting position a text plate mounted on the stamping insert and a stamping area of the mounted band unit abut against an ink pad soaked with ink in the cushion-receiving element, and that during a stamping process for producing a stamp impression the stamping insert, comprising a mounted text plate and the mounted band unit, is shiftable via the reversing mechanism into a stamping position, wherein on the stamping insert a height adjustment element for the mounted band unit and/or a text plate carrier is arranged, and the height adjustment element is connected or operatively connected to an adjustment element, wherein the adjustment element comprises a single centrally arranged set-screw, and wherein the mounted band unit and/or text plate carrier is attached via the height adjustment element to the text plate carrier and/or mounted band unit.

2. The stamp according to claim 1, wherein the mounted band unit is freely movably guided on the stamping insert via at least one guide elements.

3. The stamp according to claim 1, wherein the adjustment element is formed by a set-screw and this is provided in the central region of the height adjustment element, in particular a central bar.

4. The stamp according to claim 1, wherein the height adjustment element comprises a slide track with an angular course.

5. The stamp according to claim 1, wherein the height adjustment element comprises a guide track for horizontal guidance.

6. The stamp according to claim 1, wherein the mounted band unit is attached and adjustable via the height adjustment element.

7. The stamp according to claim 1, wherein the height-adjustment element has a bow-shaped configuration, wherein on both sides of a central bar the angular slide track and the horizontal guide track are arranged.

8. A stamping insert comprising a text plate carrier and a mounted band unit attachable to the text plate carrier, where the text plate carrier is designed to receive a text plate and the text plate carrier comprises an opening for the mounted band unit, wherein on the text plate carrier a height adjustment element is provided for the mounted band unit and/or text plate carrier, and the height adjustment element is connected to an adjustment element, comprising a centrally provided set-screw, or is in operative connection with the adjustment element, where the mounted band unit and/or text plate carrier are attached via the height adjustment element to the text plate carrier and/or the mounted band unit, and wherein the set-screw is provided in the central region of a central bar of the height adjustment element.

9. The stamping insert according to claim 8, wherein the stamping insert with the mounted band unit is subsequently installable into a stamping component of a stamp and this is designed for parallel height adjustment of the mounted band unit in a self-inking stamp.

10. The stamping insert according to claim 8, wherein the mounted band unit is freely movably guided on the stamping insert via at least one guide elements.

11. The stamping insert according to claim 8, wherein the height adjustment element comprises a slide track with an angular course.

12. The stamping insert according to claim 8, wherein the height adjustment element comprises a guide track for horizontal guidance.

13. The stamping insert according to claim 8, wherein the mounted band unit is attached and adjustable via the height adjustment element.

14. The stamping insert according to claim 8, wherein the height-adjustment element is configured bow-shaped, wherein on both sides of a central bar the angular slide track and the horizontal guide track are arranged.

15. A stamp comprising at least one stamping component and one stamping insert with a mounted band unit, wherein the stamping component comprises a top part and a bottom part with a cushion-receiving element, wherein the stamping insert, where the mounted band unit is connected so as to move synchronously via a reversing mechanism in the bottom part to the top part, wherein in the resting position a text plate mounted on the stamping insert and a stamping area of mounted band unit abut against an ink pad soaked with ink in the cushion-receiving element, and that during a stamping process for producing a stamp impression the stamping insert, in particular with a mounted text plate and the mounted band unit, is shiftable via the reversing mechanism into a stamping position, wherein on the mounted band unit at least one height adjustment element is arranged that is accessible or is actuatable via the front or rear in a resting position or a stamping position, and wherein the at least one height adjustment element comprises a set-screw positioned in the central region of a central bar of the at least one height adjustment element.

16. The stamp according to claim 15, wherein the height adjustment element is provided so as to be parallel to the text-plate mounting surface.

17. The stamp according to claim 15, wherein the height adjustment element is designed for height adjustment of the mounted band unit.

18. The stamp according to claim 17, wherein the height adjustment is performed over an angular slide track.

* * * * *